US011581114B2

(12) United States Patent
Park et al.

(10) Patent No.: US 11,581,114 B2
(45) Date of Patent: Feb. 14, 2023

(54) MAGNETIC POWDER AND COIL COMPONENT COMPRISING THE SAME

(71) Applicant: SAMSUNG ELECTRO-MECHANICS CO., LTD., Suwon-si (KR)

(72) Inventors: Il Jin Park, Suwon-si (KR); Jun Sung Lee, Suwon-si (KR); Joong Won Park, Suwon-si (KR); Gwang Hwan Hwang, Suwon-si (KR); Soon Kwang Kwon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 338 days.

(21) Appl. No.: 16/879,027

(22) Filed: May 20, 2020

(65) Prior Publication Data

US 2021/0217546 A1 Jul. 15, 2021

(30) Foreign Application Priority Data

Jan. 9, 2020 (KR) ..... 10-2020-0003324

(51) Int. Cl.

| | |
|---|---|
| ***H01F 1/33*** | (2006.01) |
| ***H01F 1/147*** | (2006.01) |
| ***H01F 1/24*** | (2006.01) |
| ***H01F 27/29*** | (2006.01) |
| ***H01F 27/28*** | (2006.01) |
| ***H01F 1/153*** | (2006.01) |

(52) U.S. Cl.

CPC ..... *H01F 1/33* (2013.01); *H01F 1/14766* (2013.01); *H01F 1/24* (2013.01); *H01F 1/15308* (2013.01); *H01F 1/15333* (2013.01); *H01F 27/2804* (2013.01); *H01F 27/292* (2013.01)

(58) Field of Classification Search

None

See application file for complete search history.

(56) References Cited

U.S. PATENT DOCUMENTS

| | | | | |
|---|---|---|---|---|
| 11,081,266 | B2 * | 8/2021 | Hosono | H01F 27/24 |
| 2013/0033354 | A1 * | 2/2013 | An | H01F 1/01 252/62.55 |
| 2013/0228716 | A1 * | 9/2013 | Suetsuna | H01F 1/01 427/127 |

(Continued)

FOREIGN PATENT DOCUMENTS

| | | |
|---|---|---|
| JP | 2010-232224 A | 10/2010 |
| JP | 2017-046462 A | 3/2017 |

(Continued)

OTHER PUBLICATIONS

Office Action issued in corresponding Korean Patent Application No. 10-2020-0003324 dated Feb. 2, 2021, with English translation.

*Primary Examiner* — Kevin M Bernatz

(74) *Attorney, Agent, or Firm* — Morgan, Lewis & Bockius LLP

(57) ABSTRACT

A magnetic powder contains a magnetic metal particle comprising iron (Fe) and an insulating coating layer disposed on a surface of the magnetic metal particle and comprising tin (Sn), phosphorous (P) and oxygen (O), and a coil component contains such a magnetic powder.

17 Claims, 3 Drawing Sheets

(56) References Cited

U.S. PATENT DOCUMENTS

| | | | | |
|---|---|---|---|---|
| 2016/0071636 | A1* | 3/2016 | Ohtsubo | B22F 1/0003 148/307 |
| 2016/0276074 | A1* | 9/2016 | Lee | H01F 1/33 |
| 2016/0309585 | A1* | 10/2016 | Nakamura | H05K 3/4038 |
| 2017/0063172 | A1* | 3/2017 | Shiohara | H02K 1/02 |
| 2019/0103207 | A1* | 4/2019 | Sato | H01F 1/24 |
| 2019/0221342 | A1* | 7/2019 | Yoshidome | H01F 1/15325 |
| 2019/0267170 | A1* | 8/2019 | Nakamura | B22F 1/16 |
| 2019/0279799 | A1* | 9/2019 | Hosono | H01F 1/15383 |
| 2019/0355498 | A1* | 11/2019 | Yoshidome | H01F 1/14741 |
| 2021/0098164 | A1* | 4/2021 | Koeda | H01F 3/08 |
| 2021/0098165 | A1* | 4/2021 | Mimura | H01F 5/003 |

FOREIGN PATENT DOCUMENTS

| | | | |
|---|---|---|---|
| JP | 6430556 | B2 | 11/2018 |
| JP | 2019-065337 | | 4/2019 |
| KR | 10-2013-0014848 | A | 2/2013 |
| KR | 10-2019-0106787 | A | 9/2019 |

* cited by examiner

MAGNETIC POWDER AND COIL COMPONENT COMPRISING THE SAME

CROSS-REFERENCE TO RELATED APPLICATION

This application claims benefit of priority to Korean Patent Application No. 10-2020-0003324, filed on Jan. 9, 2020 with the Korean Intellectual Property Office, the disclosure of which is incorporated herein by reference.

TECHNICAL FIELD

The present disclosure relates to a magnetic powder and a coil component containing the same.

BACKGROUND

Among passive elements, a coil component may include a coil portion and a body surrounding the coil portion, where the body may be formed to contain magnetic powder particles.

In this case, when the magnetic powder particles contain magnetic metal particles, there is an advantage of a high saturation magnetization value. In order to decrease an eddy current loss in a high frequency band, however, insulation between magnetic metal particles contained in the body should be secured.

Meanwhile, to secure such insulation, an insulating coating layer may be formed on a surface of the magnetic metal particle. In this case, permeability and a packing rate of the body needs to be improved by forming the insulating coating layer to be thin and even, even with low shear.

SUMMARY

An aspect of the present disclosure is to provide a magnetic powder containing a magnetic metal particle comprising iron (Fe) and an insulating coating layer disposed on a surface of the magnetic metal particle and comprising tin (Sn), phosphorous (P) and oxygen (O).

Another aspect of the present disclosure is to provide a coil component containing such a magnetic powder.

According to an aspect of the present disclosure, an insulating coating layer is formed to be thin and even, thereby securing permeability and a packing rate of a body as well as securing insulation.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
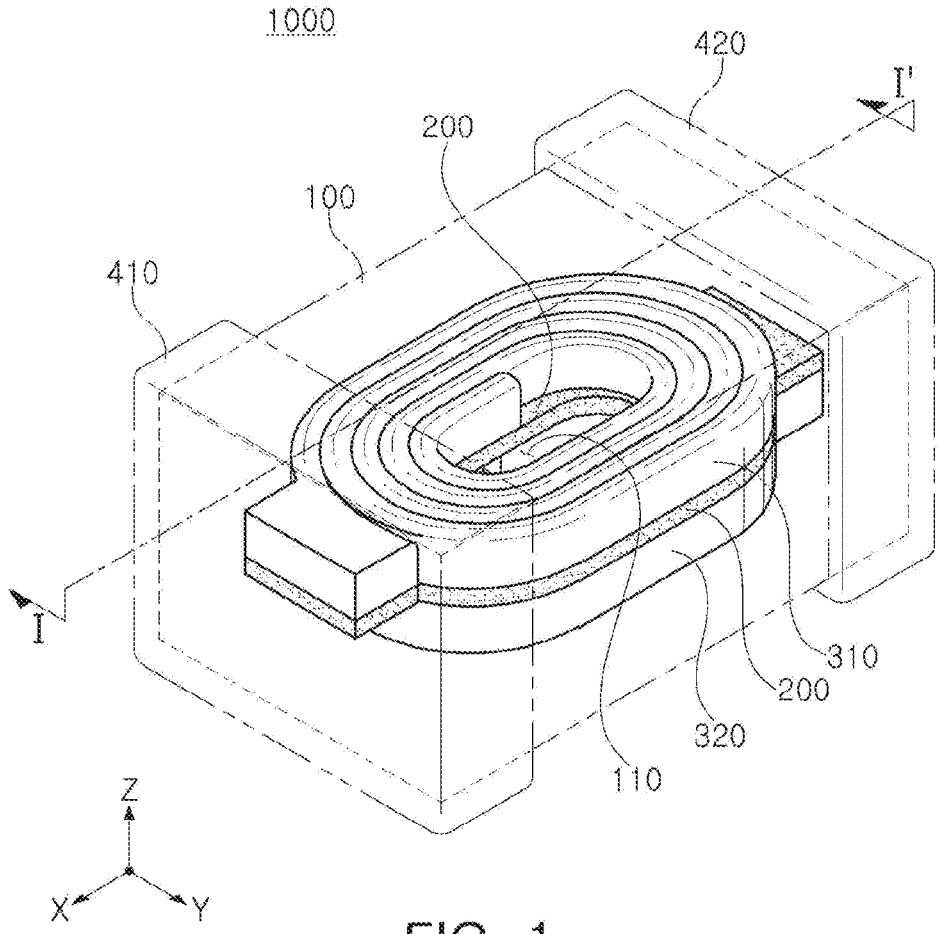
FIG. 1 is a perspective view schematically illustrating a coil portion according to Example 1 of the present disclosure.

Hereinbelow, terms referring to the elements of the present disclosure are named in consideration of the functions of the respective elements, and thus should not be understood as limiting the technical elements of the present disclosure. As used herein, singular forms may include plural forms as well unless the context explicitly indicates otherwise. Further, as used herein, the terms "include", "have", and their conjugates denote a certain feature, numeral, step, operation, element, component, or a combination thereof, and should not be construed to exclude the existence of or a possibility of addition of one or more other features, numerals, steps, operations, elements, components, or combinations thereof. In addition, it will be the term "on" does not necessarily mean that any element is positioned on an upper side based on a gravity direction, but means that any element is positioned above or below a target portion.

Throughout the specification, it will be understood that when an element or layer is referred to as being "connected to" or "coupled to" another element or layer, it can be understood as being "directly connected" or "directly coupled" to the other element or layer or intervening elements or layers may be present. It will be further understood that the terms "comprises," "comprising," "includes," and/or "including" specify the presence of elements, but do not preclude the presence or addition of one or more other elements.

The size and thickness of each component illustrated in the drawings are represented for convenience of explanation, and the present disclosure is not necessarily limited thereto.

In the drawings, the expression "X direction" may refer to "first direction" or "length direction," and the expression "Y direction" may refer to "second direction" or "width direction" while the expression "Z direction" may refer to "third direction" or "thickness direction."

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

Hereinafter, a coil component according to the Examples of the present disclosure will be described with reference to the attached drawings. The same or corresponding components were given the same reference numerals and will not further be explained.

It may be appreciated that various kinds of electronic components are used in an electronic device. In this regard, various kinds of coil components may be appropriately used in the electronic components in order to remove noise, or for other purposes.

In other words, a coil component in electronic devices may be used as a power inductor, a high frequency (HF) inductor, a general bead, a high frequency (GHz) bead, a common mode filter, or the like.

Magnetic Powder

Example 1

Figure 3:
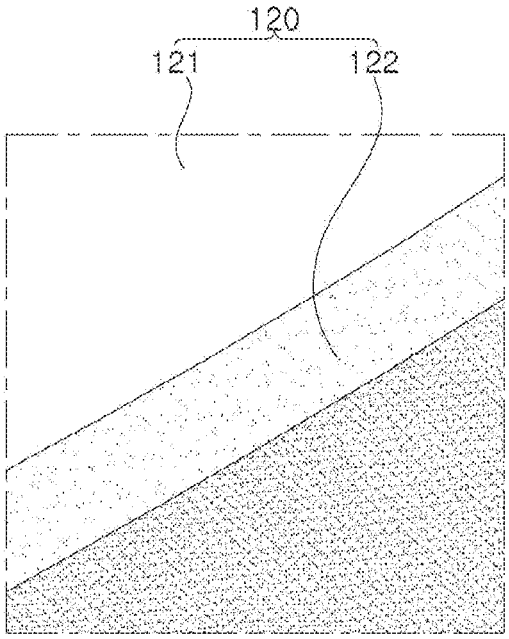
FIG. 3 is a cross sectional view of a part of a magnetic powder included in the body of the coil portion according to Example 1.

FIG. 3 is a schematic diagram illustrating a magnetic powder of the coil portion according to Example 1.

Based on FIG. 3, a magnetic powder 120 according to the present exemplary embodiment contains a magnetic metal particle 121 and an insulating coating layer 122.

The magnetic metal particle 121 is not particularly limited as long as it has magnetism. When the magnetic powder is formed as a particle containing a metal, saturation magnetic flux density is high and an L value can be prevented from being reduced even at a high current.

For example, the magnetic metal particle 121 may contain at least one material selected from the group consisting of iron (Fe)-based alloys. In the case in which the magnetic metal particle 121 is formed of the Fe-based alloy, the magnetic metal particle may have a high saturation magnetization density. The Fe-based alloy may be an amorphous alloy or a nano-crystalline alloy.

The Fe-based alloy, which is obtained by adding at least one alloy element other than Fe, has characteristics of a metal. The alloy element is not particularly limited as long as it may increase electric resistance, improve permeability and improve specific resistance to be used in a high frequency band. For example, the alloy element may include at least one of phosphorus (P), boron (B), silicon (Si), carbon (C), aluminum (Al), chromium (Cr) and molybdenum (Mo).

Although not limited, the Fe-based alloy may be, for example, an Fe—Si—B based amorphous alloy or an Fe—Si—B based nano-crystalline alloy. In the case in which the Fe-based alloy is formed of the amorphous alloy or the nano-crystalline alloy, specific resistance of the magnetic metal particle may be increased, thereby making it easy to be used in a high frequency band when applied to a coil component.

Although not limited, a particle size of the magnetic metal particle 121 may be 1 μm to 100 μm. The insulating coating layer 122 will be described below; according to the present exemplary embodiment, however, permeability of the body 100 may be improved by forming the insulating coating layer 122 to be thin and even, even when the magnetic metal particle 121 has a small particle size of 1 μm to 100 μm. The particle size of the magnetic metal particle 121 is measured using a scanning electron microscope (SEM), which is appreciated by the one skilled in the art. When using a scanning electron microscope (SEM), the particle size of the magnetic metal particle 121 is measured by setting the magnification to 1000 to 5000 times.

Based on FIG. 3, the insulating coating layer 122 containing Sn, P and O is disposed on a surface of the magnetic metal particle 121.

According to the present exemplary embodiment, the insulating coating layer 122 may contain Sn, as an additive. In this embodiment, $C_2O_5$-based glass is used as the main component. Use of a glass containing Sn as an additive on the insulating coating layer 122 surrounding the magnetic metal particle 121 can lead to formation of a thin and even insulating coating layer 122. That is, in a conventional coil component, a glass containing Zn, B, vanadium (V), or other elements was generally used as a material forming the insulating coating layer 122 to secure the insulation properties thereof. Meanwhile, in the present exemplary embodiment, a glass containing Sn having a lower glass transition temperature (Tg) relative to such conventional glass is used such than the insulating coating layer 122 can be formed even when relatively less shear is applied. Consequently, the insulating coating layer 122 is formed to be thinner and even compared to the conventional one, thereby securing the insulation properties while improving permeability and the packing factor of the body 100.

According to the exemplary embodiment, the insulating layer 122 may contain silicon (Si). In this case, the insulating coating layer 122 contains Si and O to improve bonding force with the magnetic metal particle 121. Further insulation properties is guaranteed for the insulating coating layer 122 containing P, due to a combination of P and Si contained in the insulating coating layer 122.

As an example of the glass containing Sn, the insulating coating layer 122 may contain SnO—$P_2O_5$. In this case, the magnetic powder may contain the insulating coating layer 122 in an amount of about 0.2 weight % (wt %) based on the total weight of the magnetic powder 120. The insulating coating layer 122 in the present exemplary embodiment may contain 15 wt % to 30 wt % of Sn and 10 wt % to 25 wt % of P based on the total weight of the insulating coating layer. When an amount Sn is less than 15 wt %, it is difficult to sufficiently obtain permeability and a packing factor of the body 100. The amount of Sn exceeding 30 wt % makes it difficult to maintain a shape of glass due to a porous structure of the glass containing Sn, thereby disabling to obtain sufficient insulation properties. When an amount of P is less than 10 wt %, it is difficult to amorphize the glass at a desired level whereas the amount of P exceeding 25 wt % leads to difficulty in securing desired insulation properties. Meanwhile, the insulating coating layer 122 may contain 3 wt % to 10 wt % of silicon based on the total weight of the insulating coating layer. When the amount of Si is less than 3 wt %, desired insulation properties cannot be secured, whereas the amount of Si exceeding 10 wt % makes it difficult to amorphize the glass at a desired level.

Figure 5A:
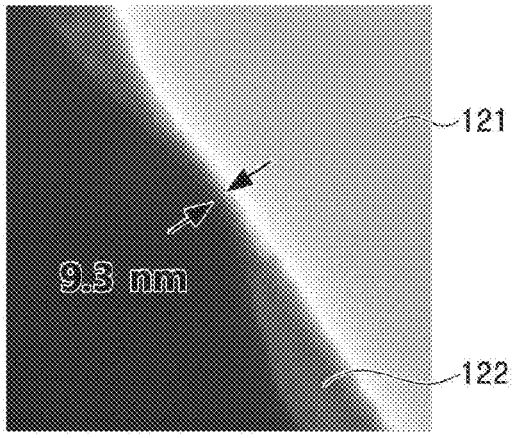
FIGS. 5A and 5B are images of a low magnitude scanning electron microscope (SEM) of an insulating coating layer of a magnetic powder in a conventional coil component.
Figure 5B:
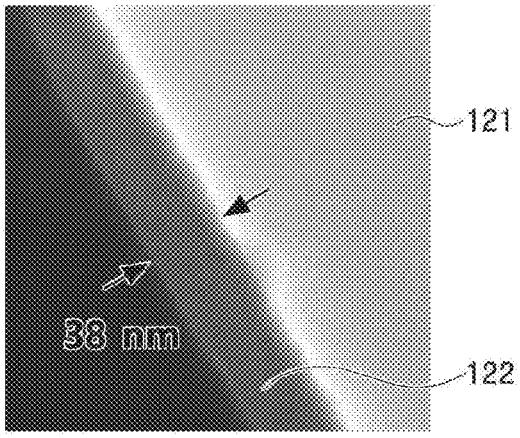
Figure 6A:
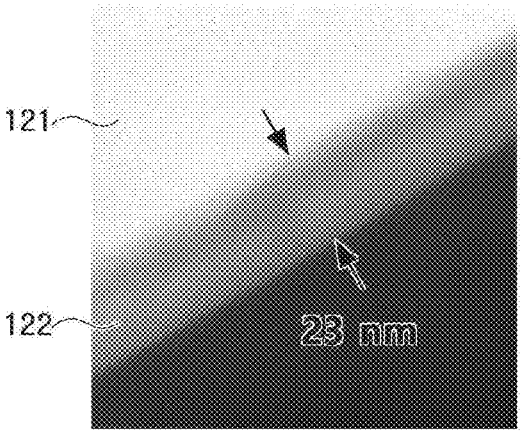
FIGS. 6A and 6B are images of a low magnitude scanning electron microscope (SEM) of the insulating coating layer of the magnetic powder according to Example 1.
Figure 6B:
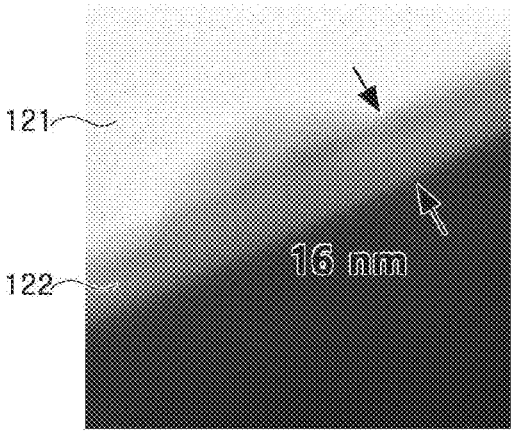

Meanwhile, as for the conventional coil component having the insulating coating layer 122 in which Sn is not contained, it is difficult to form the insulating coating layer to be even, thereby giving rise to a problem that characteristics of the component cannot be easily accomplished. FIGS. 5A and 5B are images of a low magnitude scanning electron microscope (SEM) of an insulating coating layer 122 of the conventional coil component in which Sn is not contained and, and FIGS. 6A and 6B are images of the low magnitude SEM of an insulating coating layer 122 of an embodiment of the present disclosure in which Sn is contained in an amount in a range of 15 wt % to 30 wt %. Based on FIGS. 5A and 5B, as a result of observing using a low magnitude scanning electron microscope (SEM), a minimum thickness of the insulating coating layer 122 was about 9.3 nm and a maximum thickness thereof was about 38 nm. In this case, a deviation of the thickness of the insulating coating layer 122 may be about 10 nm to 60 nm. Meanwhile, the thickness of the insulating coating layer 122 in the present exemplary embodiment depicted in FIGS. 5A and 5B may be 15 nm to 25 nm. Based on FIGS. 6A and 6B, as a result of observing using the low magnitude SEM, a minimum thickness of the insulating coating layer 122 was about 16 nm, and a maximum thickness thereof was about 23 nm. In this case, a thickness deviation of the insulating coating layer 122 may be about 10 nm to 20 nm. In other words, in the present exemplary embodiment, the insulating coating layer 122 was formed to be thin and even by containing Sn. In the present exemplary embodiment depicted in FIGS. 6A and 6B, the insulating coating layer has a thickness of 15 nm to 25 nm.

Although not limited, the insulating coating layer 122 may be formed by a spray method, a dipping method, or the like. Although not limited, when the insulating coating layer 122 is formed of a glass, the insulating coating layer 122 may be formed using a dry coating device. For example, the dry coating device includes a chamber, a friction portion disposed in the chamber and high-speed spinning based on a shaft, and a blade. When a magnetic metal particle and a glass particle are introduced into the chamber, the glass powder is softened by frictional heat between powder particles due to high speed rotation, thereby being adsorbed on a surface of the magnetic metal particle to form the insulating coating layer 122. For example, the insulating coating layer 122 may be formed by softening the glass powder with the heat generated by mechanical friction followed by coating the softened insulating coating layer 122 on the surface of the magnetic metal particle.

Modified Example of Example 1

Figure 4:
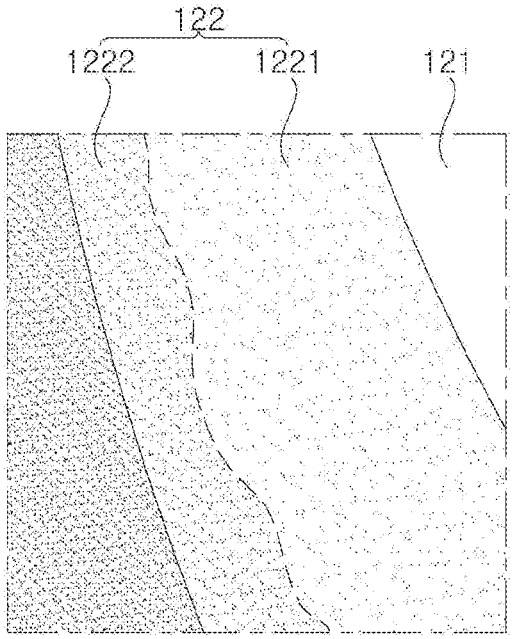
FIG. 4 is a cross sectional view of a part of an insulating layer of the magnetic powder included in a coil portion according to a modified example of Example 1.
Figure 7A:
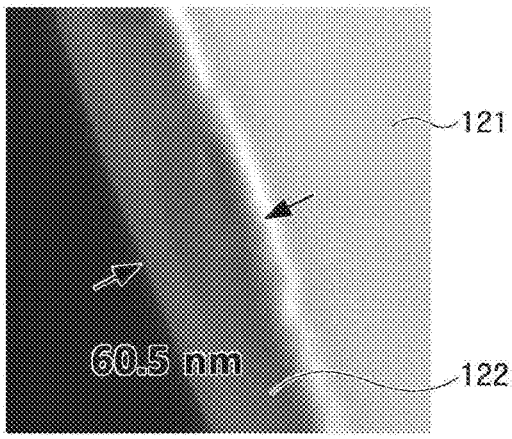
FIGS. 7A and 7B are images of a low magnitude scanning electron microscope (SEM) of the insulating coating layer of the magnetic powder according to the modified example of Example 1.
Figure 7B:
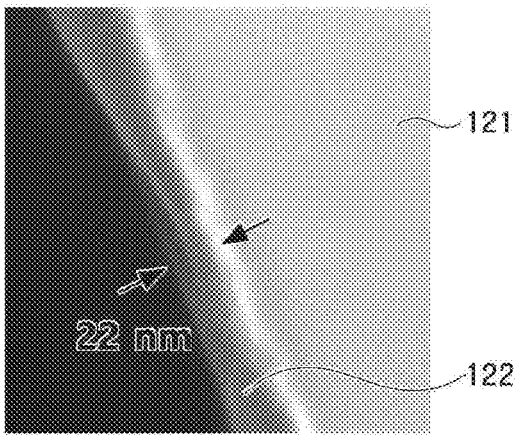

FIG. 4 is a schematic diagram illustrating a coil portion according to a modified example of Example 1, and FIGS. 7A and 7B are enlarged views of the insulating coating layer of the magnetic powder according to the modified example of Example 1.

Based on FIG. 4, a coil component 1000 according to the present modified example, in comparison with the coil component 1000 according to Example 1, has a different composition of the insulating coating layer 122. Accordingly, the composition of the insulating coating layer 122, which is the only difference from the Example 1, is described. The description of the remaining constitutions in Example 1 can be applied to the present exemplary embodiment.

In the present modified example, the insulating coating layer may further contain Zn, as an additional additive. That is, enhanced insulation properties can be secured in the present modified example, as compared to the case in which only Sn is contained, thereby lowering insulation resistance. As an example of the glass containing Sn and Zn, the insulating coating layer 122 contains $SnO—P_2O_5$ and $ZnO—P_2O_5$. In this case, the insulating coating layer 122 may contain about 0.1 wt % of $SnO—P_2O_5$ and about 0.2 wt % of $ZnO—P_2O_5$.

Based on FIG. 4, the insulating coating layer 122 includes a first region 1221 surrounding the magnetic metal particle 121 directly contacting with a surface of the magnetic metal particle 121, and a second region 1222 disposed an outside surface of the first region 1221. The second region 1222 may contain a larger amount of Sn compared to the first region 1221. Further, the second region 1222 may contain a larger amount of Zn compared to the first region 1221. In the previously described process of forming the insulating coating layer 122, rearrangement of the glass powder may occur while the glass powder is being softened. Due to the porous structure thereof, a relatively larger amount of the glass containing Sn or Zn may be distributed in an outermost region of the magnetic metal particle 121.

The second region 1222 contains 6 wt % to 18 wt % of Sn and 20 wt % to 40 wt % of P based on the total weight of the insulating coating layer 122. When an amount of Sn is less than 6 wt %, the permeability and packing factor of the body 100 cannot be sufficiently secured, whereas the Sn amount exceeding 18 wt % makes it difficult to maintain a shape of the glass due to the porous structure of the glass containing Sn and thus to secure sufficient insulation properties. When an amount of P is less than 20 wt %, it is difficult to amorphize the glass at a desired level, whereas the amount of P exceeding 40 wt % leads to difficulty in securing desired insulation properties. Meanwhile, the second region of the insulating coating layer 1222 may contain 1 wt % to 5 wt % of silicon based on the total weight of the insulating coating layer. When the amount of Si is less than 1 wt %, desired insulation properties cannot be secured, whereas the amount of Si exceeding 5 wt % makes it difficult to amorphize the glass at a desired level.

In the modified example of Example 1 of the present exemplary embodiment, a thickness of the insulating coating layer 122 may be 20 nm to 61 nm. FIGS. 7A and 7B are images of the low magnitude SEM of an insulating coating layer 122 of the modified example of Example 1 of the present disclosure. Based on FIGS. 7A and 7B, as a result of observing using a low magnitude SEM, a minimum thickness of the insulating coating layer 122 was about 22 nm and a maximum thickness thereof was about 60.5 nm. In this case, a deviation of the thickness of the insulating coating layer 122 may be about 20 nm to 40 nm. In other words, in the present exemplary embodiment, the insulating coating layer 122 was formed to be thin and even compared to the conventional insulating coating layer by containing Sn and Zn. In the modified embodiment of Example 1, the thickness of the insulating coating layer 122 may be 20 nm to 61 nm.

Coil Component

Figure 2:
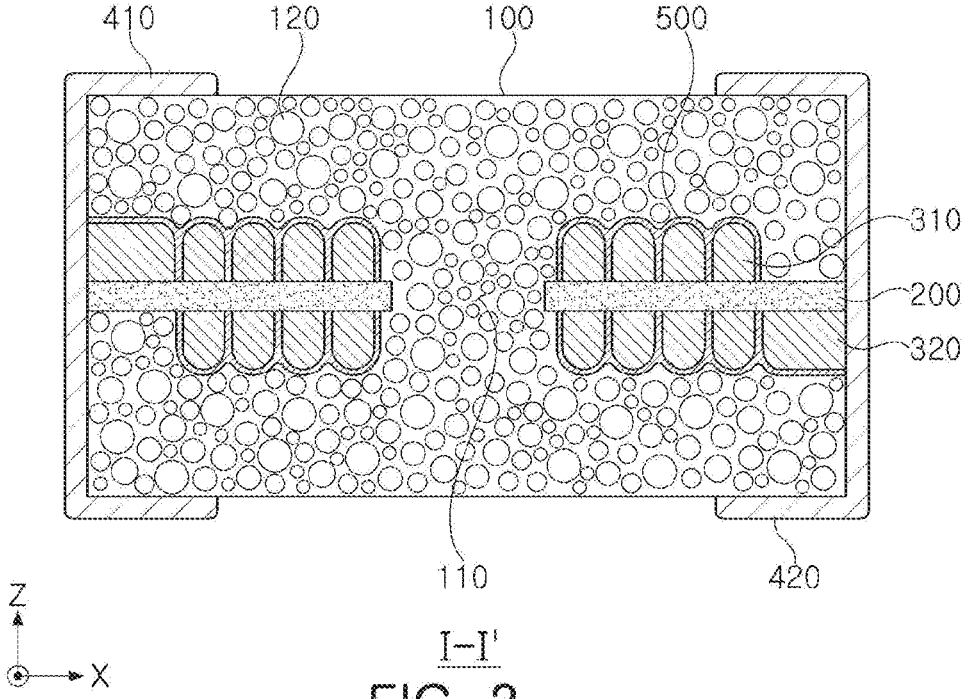
FIG. 2 is a cross-sectional view of the coil portion of FIG. 1 taken along line I-I'.

FIG. 1 is a perspective view schematically illustrating a coil portion according to Example 1, and FIG. 2 is a cross-sectional view of the coil portion of FIG. 1 taken along line I-I'.

Based on FIGS. 1 and 2, an inductor used in a power supply line of a power supply circuit is illustrated as an example of the coil component. The coil electronic component according to the present exemplary embodiment, however, may be appropriately applied as a bead, a filter, and the like, in addition to the inductor.

In addition, a thin film type inductor will be described as an example of the inductor, but is not limited thereto. The coil electronic component according to the present exemplary embodiment may be appropriately applied as a winding type inductor.

The coil electronic component 100 may include a body 100, a support substrate 200, first and second coil portions 310 and 320, first and second external electrodes 410 and 420 and an insulating film 500.

The body 100 may have an approximately hexahedral shape. Although not illustrated specifically, the boy 100 may include first and second surfaces opposing in a thickness (Z) direction, third and fourth surfaces opposing in a length (X) direction and fifth and sixth surfaces opposing in a width (Y) direction. Although not limited, the body 100 may have a greater length in the length direction than in the width direction, resulting in a rectangular parallelepiped shape.

The body 100 may form an exterior of the coil component 100 and may contain the magnetic powder according to the previously described exemplary embodiments. The magnetic powder 120 may be dispersed in a polymer, such as an epoxy resin or polyimide, to be included in the body 100.

As described below, the body 100 includes a core portion 110 penetrating the first and second coil portions 310 and 320. The core portion 110 may be formed by a magnetic composite sheet filling a through-hole of the first and second coil portions 310 and 320, but is not limited thereto.

The body 100 may contain a magnetic powder 120 and a resin. Specifically, the body 100 may be formed by stacking at least one magnetic composite sheet containing a resin and a magnetic powder 120 dispersed in the resin. However, the body 100 may have a structure different from the structure in which the magnetic powder 120 is dispersed in the resin. For example, the body 100 may be formed of a magnetic material such as ferrite.

Descriptions of the same features as those of the magnetic powder according to the exemplary embodiment described above is omitted in order to avoid repeated descriptions.

The support substrate 200 is embedded in the body 100 to be spaced apart from each other inside the body 100. The support substrate 200 includes one surface and the other surface opposing thereto as well as first and second coil portions 310 and 320 described below.

The support substrate 200 is formed of an insulating material such as a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) resin, a photoimageable dielectric (PID), and the like, but is not limited thereto.

The first and second coil portions 310 and 320 are spaced apart on the one and other surfaces of the support substrate 200 and exhibit the characteristics of a coil component. As an example, when the coil component 1000 is used as a power inductor, an output voltage may be maintained constant.

The first and second coil portions 310 and 320 forms a plurality of turns based on the core portion 110.

Specifically, the first and second coil portions 310 and 320 include one end portion and the other end portion connected by a plurality of the turns. As an example, the one end portion of the first coil portion 310 is exposed onto the third surface of the body 100 to be connected to a first external electrode 410, while the one end portion of the second coil portion 320 is exposed onto the fourth surface of the body 100 to be connected to a second external electrode 420.

The first and second coil portions 310 and 320 may be formed to have a spiral shape and may be electrically connected via a via electrode (not illustrated) formed on the support substrate 200.

The first and second coil portions 310 and 320 and the via electrode (not illustrated) may be formed of a conductive material, such as copper (Cu), aluminum (Al), silver (Ag), tin (Sn), gold (Au), nickel (Ni), lead (Pb), titanium (Ti) or alloys thereof, but are not limited thereto.

The first and second external electrodes 410 and 420 are disposed outside of the body 100 and spaced apart from each other so as to cover the one end portion of each of the first and second coil portions 310 and 320.

The first and second external electrodes 410 and 420 may be formed by using a paste containing a metal having superior electric conductivity; for example, the first and second external electrodes 410 and 420 may be a conductive paste containing Ni, Cu, Sn, or Ag alone or alloys thereof. Further, a plating layer may be further formed on each of the first and second external electrodes 410 and 420. In this case, the plating layer may contain at least one selected from the group consisting of nickel (Ni), copper (Cu) and tin (Sn); for example, a nickel (Ni) layers and a tin (Sn) layer may be sequentially formed.

The first and second coil portions 310 and 320 may be covered by the insulating film 500. The insulating film 500 may be formed by a known method such as a screen-printing method, exposure and development processes on a photoresist (PR), a spray-application process, vapor deposition, or the like. The insulating film 500 may be formed as a thin film using a parylene resin. As covered by the insulating film 500, the first and second coil portions 310 and 320 may not be in direct contact with the magnetic powder 120 contained in the body 100.

As set forth above, according to exemplary embodiments, insulation properties can be secured while improving permeability and a packing factor of a body by forming an insulating coating film to be thin and even.

The present disclosure is not limited to the above exemplary embodiments and the attached drawings, but is limited by the appended claims.

While exemplary embodiments have been shown and described above, it is apparent to those skilled in the art that modifications and variations could be made without departing from the scope of the present invention as defined by the appended claims.

What is claimed is:

1. A magnetic powder, comprising:

a magnetic metal particle comprising iron (Fe); and an insulating coating layer disposed on a surface of the magnetic metal particle and comprising tin (Sn), phosphorous (P) and oxygen (O), wherein the insulating coating layer comprises 15 wt % to 30 wt % of Sn and 10 wt % to 25 wt % of P based on a total weight of the insulating coating layer.

2. The magnetic powder of claim 1, wherein the insulating coating layer comprises $SnO—P_2O_5$.

3. The magnetic powder of claim 1, wherein the magnetic powder comprises the insulating coating layer in an amount of 0.2 wt % based on a total weight of the magnetic powder.

4. The magnetic powder of claim 1, wherein the insulating coating layer comprises 3 wt % to 10 wt % of silicon based on a total weight of the insulating coating layer.

5. The magnetic powder of claim 1, wherein the insulating coating layer has a thickness of 15 nm to 25 nm.

6. The magnetic powder of claim 1, wherein a particle size of the magnetic metal particle is 1 μm to 100 μm.

7. The magnetic powder of claim 1, wherein the magnetic metal particle comprises a Fe—Si—B based amorphous alloy or a Fe—Si—B based nano-crystalline alloy.

8. A magnetic powder, comprising:

a magnetic metal particle comprising iron (Fe); and an insulating coating layer disposed on a surface of the magnetic metal particle and comprising tin (Sn), phosphorous (P), zinc (Zn) and oxygen (O), wherein the insulating coating layer comprises 15 wt % to 30 wt % of Sn and 10 wt % to 25 wt % of P based on a total weight of the insulating coating layer.

9. The magnetic powder of claim 8, wherein the insulating coating layer comprises $SnO—P_2O_5$ and $ZnO—P_2O_5$.

10. The magnetic powder of claim 8, wherein the insulating coating layer comprises 0.1 wt % of $SnO—P_2O_5$ and 0.2 wt % of $ZnO—P_2O_5$.

11. The magnetic powder of claim 8, wherein the insulating coating layer comprises a first region surrounding the magnetic metal particle directly contacting with a surface of the magnetic metal particle, and a second region disposed on an outside surface of the first region.

12. The magnetic powder of claim 11, wherein the second region comprises a larger amount of Sn than the first region.

13. The magnetic powder of claim 11, wherein the second region comprises a larger amount of Zn than the first region.

14. The magnetic powder of claim 11, wherein the second region comprises 6 wt % to 18 wt % of Sn and 20 wt % to 40 wt % of P based on a total weight of the insulating coating layer.

15. The magnetic powder of claim 11, wherein the second region comprises 1 wt % to 5 wt % of silicon based on a total weight of the insulating coating layer.

16. The magnetic powder of claim 8, wherein the insulating coating layer has a thickness of 20 nm to 61 nm.

17. A magnetic powder, comprising:

a magnetic metal particle comprising iron (Fe); and an insulating coating layer disposed on a surface of the magnetic metal particle and comprising tin (Sn), phosphorous (P) and oxygen (O), wherein the insulating coating layer comprises $C_2O_5$-based glass is used as the main component, and the insulating coating layer comprises 15 wt % to 30 wt % of Sn and 10 wt % to 25 wt % of P based on a total weight of the insulating coating layer.

* * * * *